US005098520A

United States Patent [19]

Begala

[11] Patent Number: 5,098,520

[45] Date of Patent: Mar. 24, 1992

[54] PAPERMAKING PROCESS WITH IMPROVED RETENTION AND DRAINAGE

[75] Inventor: Arthur J. Begala, Naperville, Ill.

[73] Assignee: Nalco Chemcial Company, Naperville, Ill.

[21] Appl. No.: 645,797

[22] Filed: Jan. 25, 1991

[51] Int. Cl.[5] ..... D21H 17/34

[52] U.S. Cl. ..... 162/168.1; 162/168.2; 162/168.3; 162/181.1; 162/183

[58] Field of Search ..... 162/168.3, 183, 168.2, 162/168.1, 181.1

[56] References Cited

U.S. PATENT DOCUMENTS

| | | | |
|---|---|---|---|
| 3,021,257 | 2/1962 | Stauffenberg | 162/168.3 |
| 3,117,944 | 1/1964 | Harrell | 260/41 |
| 4,388,150 | 6/1983 | Sunden et al. | 162/175 |
| 4,643,801 | 2/1987 | Johnson | 162/164.1 |
| 4,749,444 | 6/1988 | Lorz et al. | 162/183 |
| 4,753,710 | 6/1988 | Langley et al. | 162/164.3 |
| 4,874,466 | 10/1989 | Savino | 162/164.3 |
| 4,913,775 | 4/1990 | Langley et al. | 162/164.3 |

FOREIGN PATENT DOCUMENTS

| | | | |
|---|---|---|---|
| 759363 | 5/1967 | Canada . | |
| 1110019 | 10/1981 | Canada | 162/168.3 |
| 295794 | 12/1988 | Japan . | |
| WO8600100 | 1/1986 | PCT Int'l Appl. . | |
| WO8605826 | 10/1986 | PCT Int'l Appl. . | |
| 631483 | 11/1949 | United Kingdom . | |

OTHER PUBLICATIONS

"Pulp and Paper", John Wiley & Sons, Inc., 3rd Ed., 1981, pp. 1448-1458 and 1602-1603.

"Microparticles in Wet End Chemistry", Retention and Drainage Short Course, 1989, Washington, D.C., Tappi Press, Atlanta, Ga., Kurt Moberg.

"Silicates in Paper Products Improve Strength and Function Performance", James S. Falcone et al., *Pulp & Paper*, Jan. 1976, pp. 93-96.

*Primary Examiner*—Peter Chin

*Attorney, Agent, or Firm*—Joan I. Norek; Robert A. Miller; Donald G. Epple

[57] ABSTRACT

A papermaking process includes the steps of adding to the papermaking celllulosic slurry first a high molecular weight cationic polymer and then a medium weight anionic polymer. The cationic polymer is added after the addition of filler, but before at least one of the shear stages to which the slurry is subjected prior to sheet formation and drainage. The anionic polymer is added after the shear stage which is subsequent to the addition of the cationic polymer.

19 Claims, No Drawings

PAPERMAKING PROCESS WITH IMPROVED RETENTION AND DRAINAGE

TECHNICAL FIELD OF THE INVENTION

The present invention is in the technical field of papermaking, and more particularly in the technical field of wet-end additives to papermaking furnish.

BACKGROUND OF THE INVENTION

In the manufacture of paper an aqueous cellulosic suspension or slurry is formed into a paper sheet. The cellulosic slurry is generally diluted to a consistency (percent dry weight of solids in the slurry) of less than 1 percent, and often below 0.5 percent ahead of the paper machine, while the finished sheet must have less the 6 weight percent water. Hence the dewatering aspects of papermaking are extremely important to the efficiency and cost of the manufacture.

The dewatering method of the least cost in the process is drainage, and thereafter more expensive methods are used, for instance vacuum, pressing, felt blanket blotting and pressing, evaporation and the like, and in practice a combination of such methods are employed to dewater, or dry, the sheet to the desired water content. Since drainage is both the first dewatering method employed and the least expensive, improvement in the efficiency of drainage will decrease the amount of water required to be removed by other methods and hence improve the overall efficiency of dewatering and reduce the cost thereof.

Another aspect of papermaking that is extremely important to the efficiency and cost of the manufacture is retention of furnish components on and within the fiber mat being formed during papermaking. A papermaking furnish contains generally particles that range in size from about the 2 to 3 millimeter size of cellulosic fibers, to fillers at a few microns, and to colloids. Within this range are cellulosic fines, mineral fillers (employed to increase opacity, brightness and other paper characteristics) and other small particles that generally, without the inclusion of one or more retention aids, would in significant portion pass through the spaces (pores) between the cellulosic fibers in the fiber mat being formed during papermaking.

One method of improving the retention of cellulosic fines, mineral fillers and other furnish components on the fiber mat is the use of a coagulant/flocculant system, added ahead of the paper machine. In such a system there is first added a coagulant, for instance a low molecular weight cationic synthetic polymer or a cationic starch to the furnish, which coagulant generally reduces the negative surface charges present on the particles in the furnish, particularly cellulosic fines and mineral fillers, and thereby accomplishes a degree of agglomeration of such particles, followed by the addition of a flocculant. Such flocculant generally is a high molecular weight anionic synthetic polymer which bridges the particles and/or agglomerates, from one surface to another, binding the particles into large agglomerates. The presence of such large agglomerates in the furnish as the fiber mat of the paper sheet is being formed increases retention. The agglomerates are filtered out of the water onto the fiber web, where unagglomerated particles would to a great extent pass through such paper web.

While a flocculated agglomerate generally does not interfere with the drainage of the fiber mat to the extent that would occur if the furnish were gelled or contained an amount of gelatinous material, when such flocs are filtered by the fiber web the pores thereof are to a degree reduced, reducing the drainage efficiency therefrom. Hence the retention is being increased with some degree of deleterious effect on the drainage.

Another system employed to provide an improved combination of retention and dewatering is described in U.S. Pat. Nos. 4,753,710 and 4,913,775, inventors Langley et al., issued respectively June 28, 1988 and Apr. 3, 1990, incorporated hereinto by reference. In brief, such method adds to the aqueous cellulosic papermaking suspension first a high molecular weight linear cationic polymer before shearing the suspension, followed by the addition of bentonite after shearing. The shearing generally is provided by one or more of the cleaning, mixing and pumping stages of the papermaking process, and the shearing breaks down the large flocs formed by the high molecular weight polymer into microflocs, and further agglomeration then ensues with the addition of the bentonite clay particles.

Another system uses the combination of cationic starch followed by colloidal silica to increase the amount of material retained on the web by the method of charge neutralization and adsorption of smaller agglomerates. This system is described in U.S. Pat. No. 4,388,150, inventors Sunden et all, issued June 14, 1983.

Dewatering generally, and particularly dewatering by drainage, is believed improved when the pores of the paper web are less plugged, and it is believed that retention by adsorption in comparison to retention by filtration reduces such pore plugging.

Greater retention of fines and fillers permits, for a given grade of paper, a reduction in the cellulosic fiber content of such paper. As pulps of less quality are employed to reduce papermaking costs, the retention aspect of papermaking becomes even more important because the fines content of such lower quality pulps is greater generally than that of pulps of higher quality.

Greater retention of fines, fillers and other slurry components reduces the amount of such substances lost to the white water and hence reduces the amount of material wastes, the cost of waste disposal and the adverse environmental effects therefrom.

Another important characteristic of a given papermaking process is the formation of the paper sheet produced. Formation is determined by the variance in light transmission within a paper sheet, and a high variance is indicative of poor formation. As retention increases to a high level, for instance a retention level of 80 or 90 percent, the formation parameter generally abruptly declines from good formation to poor formation. It is at least theoretically believed that as the retention mechanisms of a given papermaking process shift from filtration to adsorption, the deleterious effect on formation, as high retention levels are achieved, will diminish, and a good combination of high retention with good formation is attributed to the use of bentonite in U.S. Pat. No. 4,913,775.

It is generally desirable to reduce the amount of material employed in a papermaking process for a given purpose, without diminishing the result sought. Such add-on reductions may realize both a material cost savings and handling and processing benefits.

It is also desirable to use additives that can be delivered to the paper machine without undue problems. An additive that is difficult to dissolve, slurry or otherwise disperse in the aqueous medium may require expensive equipment to feed it to the paper machine. When difficulties in delivery to the paper machine are encountered, the additive is often maintained in aqueous slurry form by virtue of high energy imput equipment. In contrast, additives that are easily dissolved or dispersed in water require less energy and expense and their uniformity of feed is more reliable.

DISCLOSURE OF THE INVENTION

The present invention provides a papermaking process in which paper or paperboard is made by the the general steps of forming an aqueous cellulosic slurry, subjecting such slurry to one or more shear stages, adding a mineral filler to the slurry prior to at least one of such shear stages, and draining such slurry to form a sheet which is then dried, wherein a high molecular weight cationic polymer is added to the slurry after the mineral filler and before one of the shear stages, characterized in that after the addition of such high molecular weight cationic polymer and the subsequent shear stage, a medium molecular weight anionic polymer is added to the slurry.

PREFERRED EMBODIMENTS OF THE INVENTION

The treatment of an aqueous cellulosic slurry with a high molecular weight cationic polymer followed by shear, preferably a high degree of shear, is a wet-end treatment in itself known in the field, for instance as described in aforesaid U.S. Pat. Nos. 4,753,710 and 4,913,775, inventors Langley et al., issued respectively June 28, 1988, and Apr. 3, 1990, incorporated herein by reference. The present invention departs from the disclosures of these patents in the use of a medium molecular weight anionic polymer after the shear, instead of bentonite. As described in these patents, paper or paper board is generally made from a suspension or slurry of cellulosic material in an aqueous medium, which slurry is subjected to one or more shear stages, which stages generally are a cleaning stage, a mixing stage and a pumping stage, and thereafter the suspension is drained to form a sheet, which sheet is then dried to the desired, and generally low, water concentration. As disclosed in these patents, the cationic polymer generally has a molecular weight of at least 500,000, and preferably the molecular weight is above 1,000,000 and may be above 5,000,000, for instance in the range of from 10 to 30 million or higher. The cationic polymer is substantially linear; it may be wholly linear or it can be slightly cross linked provided its structure is still substantially linear in comparison with the globular structure of cationic starch. Preferably the cationic polymer has a relatively high charge density of for instance about 0.2 and preferably at least about 0.35, and most preferably about 0.4 to 2.5 or higher, equivalents of cationic nitrogen per kilogram of polymer. When the polymer is formed by polymerization of cationic, ethylenically unsaturated monomer, optionally with other monomers, the amount of cationic monomer will normally be above 2 mole percent and usually above 5 mole percent, and preferably above 10 mole percent, based on the total moles of monomer used in forming the polymer. The amount of the cationic polymer employed in the process, in the absence of any substantial amount of cationic binder, is typically at least 0.3 percent based on dry weight of the slurry, and preferably 0.6 percent in the substantial absence of cationic binder and 0.5 percent in the presence of cationic binder, same basis, which is from 1.1 to 10 times, and usually 3 to 6 times, the amount of cationic polymer that would be used in conventional (dual polymer) processes, and hence is considered "an excess amount" of cationic polymer. The cationic polymer is preferably added to thin stock, preferably cellulosic slurry having a consistency of 2 percent or less, and at most 3 percent. The cationic polymer may be added to prediluted slurry, or may be added to a slurry together with the dilution water.

Also as described in aforesaid patents, the use of the excess amount of synthetic cationic polymeric flocculant is believed necessary to ensure that the subsequent shearing results in the formation of microflocs which contain or carry sufficient cationic polymer to render at least parts of their surfaces cationically charged, although it is not necessary to render the whole slurry cationic. Thus the Zeta potential of the slurry, after the addition of the cationic polymer and after the shear stage, may be cationic or anionic.

Further as described in aforesaid patents, the shear may be provided by a device in the apparatus for other purposes, such as a mixing pump, fan pump or centriscreen, or one may insert into the apparatus a shear mixer or other shear stage for the purpose of providing shear, and preferably a high degree of shear, subsequent to the addition of the cationic polymer. The cationic monomers of the cationic polymer are generally dialkyl amino alkyl (meth)acrylates or (meth)acrylamides, as acid salts or preferably quaternary ammonium salts. The alkyl groups may contain 1 to 4 carbon atoms and the aminoalkyl groups may contain 1 to 8 carbon atoms. These cationic monomers are preferably polymerized with nonionic monomers, preferably acrylamide, and preferably have an intrinsic viscosity ("IV") above 4 dl/g. Other suitable cationic polymers are polyethylene imines, polyamine epichlorhydrin polymers, and homo- or copolymers, generally with acrylamide, or monomers such as diallyl ammonium chloride. Any conventional cationic synthetic linear polymeric flocculant suitable as a paper retention aid may be used, and it may contain a minor amount of anionic groups, rendering it amphoteric.

The process can employ a cellulosic slurry that contains, prior to the addition of the cationic polymer, a cationic binder, such as cationic starch or urea formaldehyde resin, or relatively low molecular weight dry strength resin which is more cationic than anionic, typically in amounts of from about 0.01 to 1 percent, based on dry solids of the slurry, and when the stock has a high cationic demand and/or contains significant amounts of pitch, up to 0.5 percent, same basis, of a second cationic polymer having an intrinsic viscosity generally below 5, and often below 2, and molecular weight above 50,000, and generally below 400,000 although in instances it can be up to 1 or even 2 million.

The anionic polymer should be added to the cellulosic slurry before the formation of the paper product, but after any processing of the slurry under significant shear conditions in preferred embodiment. Nonetheless the anionic polymer should become substantially dispersed within the slurry before formation of the paper product. The addition of the anionic polymer in aqueous medium, for instance as a water solution or dispersion, facilitates the dispersion of the polymer in the slurry. In preferred embodiment the anionic polymer is added to the cellulosic slurry subsequent to the processing step of pumping the cellulosic slurry to the site of the papermaking screen on which the paper sheet is formed and drained.

Other additives may be charged to the cellulosic slurry without any substantial interference with the activity of the cationic polymer/anionic polymer combination of the present invention. Such other additives include for instance sizing agents, such as alum and rosin, pitch control agents, extenders such as anilex, biocides and the like. As mentioned elsewhere herein, however, in preferred embodiment the cellulosic slurry should be, at the time of the addition of the cationic polymer, anionic or at least partially anionic, and hence the choice of other additives preferably should be made with such anionic nature of the slurry as a limiting factor.

The present process is believed applicable to all grades and types of paper products that contain the fillers described herein, and further applicable for use on all types of pulps including, without limitation, chemical pulps, including sulfate and sulfite pulps from both hard and soft woods, thermo-mechanical pulps, mechanical pulps and ground wood pulps, although it is believed that the advantages of the process of the present invention are best achieved when the pulp employed is of the chemical pulp type, particularly alkaline chemical pulp.

In preferred embodiment the filler used in the cellulosic slurry is anionic, or at least partially anionic, and it is believed that the advantages of the present process are best achieved when the filler is an alkaline carbonate. Other mineral, or inorganic, fillers may however, be used, or used in part, such as titanium dioxide, kaolin clay and the like.

The amount of alkaline inorganic filler generally employed in a papermaking stock is from about 10 to about 30 parts by weight of the filler, as $CaCO_3$, per hundred parts by weight of dry pulp in the slurry, but the amount of such filler may at times be as low as about 5, or even about 2, parts by weight, and as high as about 40 or even 50 parts by weight, same basis.

The amount of cationic polymer that may be used in the process of the present invention may be within the range of from about 0.01 to about 1.5 parts by weight per hundred parts by weight of dry solids in the cellulosic slurry, including both pulp and filler solids. In preferred embodiment the cationic polymer is used in the amount of from about 0.05 to about 0.5 parts by weight per hundred parts by weight of dry solids in the cellulosic slurry.

The level of such cationic polymer may also be correlated with the amount of filler in the cellulosic stock. The cationic polymer used may be within the range of from about 0.01 to about 20 parts by weight per hundred parts by weight of the filler, as $CaCO_3$, and preferably will be in the range of from about 0.1 to about 10 parts by weight, and more preferably from about 0.1 to about 2.5 parts by weight, same basis.

The amount of anionic polymer that may be employed in the process of the present invention may be within the range of from about 0.005 to about 0.5 parts by weight per hundred parts by weight of dry solids in the cellulosic slurry, including both pulp and filler solids. In most systems, there would, however, be little to no practical reason to exceed 0.2 parts by weight of the anionic polymer per hundred parts by weight of the dry solids in the cellulosic slurry, and an excessive amount of anionic polymer may be not only unnecessarily expensive but also a detriment to the process, decreasing the advantages achieved thereby. In preferred embodiment the amount of anionic polymer used in the process is within the range of from about 0.01 to about 0.2 parts by weight per hundred parts by weight of dry solids. In terms of the amount of anionic polymer used with respect to the amount of filler employed, generally an amount of anionic polymer within the range of from about 0.01 to about 5.0 parts by weight per hundred parts by weight of dry filler, as $CaCO_3$, is satisfactory, although in most systems there would be no practical reason to exceed 1.0 parts by weight, or even 0.5 parts by weight, same basis, and in preferred embodiment the amount of anionic polymer employed is within the range of from about 0.05 to about 0.5 parts by weight, same basis.

The intrinsic viscosities of the acrylic acid polymers and copolymers as reported herein were determined in 1M sodium chloride solution from published data, and the polymers as so determined were in the sodium salt form. Similarly all molecular weights of the polymers as reported herein are the approximate weight average molecular weights of the polymers in sodium salt form. The sodium salt form of the anionic polymers is used in the process of the present invention as exemplified in certain of the Examples which follow. Nonetheless, the anionic polymers chosen for use in the present invention need not be in salt form as charged to the slurry, and the anionic polymer will be substantially ionized within the slurry even if charged in acid form, and even if the slurry is acidic, rather than alkaline. Charging the anionic polymer in salt form, particularly alkali metal salt form, is however suitable for the present process.

The Anionic Polymer

The anionic polymer added to the cellulosic slurry after treatment with the high molecular weight cationic polymer, followed by the shear step, is a medium molecular weight anionic polymer. Such polymer has a weight average molecular weight generally within the range of from about 50,000 to about 3,500,000, although it is believed that for at least some anionic polymers a molecular weight of as low as about 30,000 or as high as about 5,000,000 may be useful in the present process. In preferred embodiment the weight average molecular weight of the anionic polymer is within the range of from about 75,000 to about 1,250,000. In terms of intrinsic viscosity ("IV"), the anionic polymer generally is within the range of from about 0.3 to about 1.5, and in instances may be as low as about 0.2 and as high as about 2.5. In preferred embodiment the anionic polymer has an IV within the range of from about 0.5 to about 1.5.

The anionic polymer preferably contains ionizable anionic groups such as carboxylate, sulfonate, phosphonate, and the like, and combinations thereof, and preferably there is some degree of ionization of such groups at the pH of the slurry in which the anionic polymer is used. The anionic polymer need not be comprised wholly of mer units having ionizable anionic groups, but instead may further contain nonionic mer units and to an extent cationic mer units. Such anionic polymer generally contains 65 mole percent mer units having ionizable anionic groups, and in preferred embodiment at least 80 mole percent of mer units having ionizable anionic groups, but for at least some anionic polymers a mole percentage of mer units having ionizable anionic groups may be as low as 55 mole percent. Such mer units having ionizable anionic groups may be of the type having a single anionic group per mer unit, for instance acrylic acid, or of the type having a plurality of ionizable mer units such as maleic acid (or maleic anhydride).

The anionic polymer preferably has an anionic charge density of at least about 4.8 equivalents of anionic oxygen per kilogram of polymer, and preferably of at least about 6.7, or even 10.6, equivalents per kilogram, same basis. Nonetheless, for at least some anionic polymers a sufficient anionic charge density may be as low as about 3.0 equivalents of anionic oxygen per kilogram of polymer, depending on the anionic mer unit chosen and the comonomer(s) mer units employed.

The anionic polymer, as noted above, may be a polyampholyte, provided of course that the cationic mer unit content of such polymer is not predominant, as indicated above for the anionic mer unit percentages and anionic charge densities. When the anionic polymer is a polyampholyte, in preferred embodiment the mole percentage of cationic mer units therein does not exceed 15 mole percent, and hence in preferred embodiment the mole percentage of cationic mer units in the anionic polymers is from 0 to about 15 mole percent.

The anionic polymer may also be slightly cross linked, for instance by the incorporation of multifunctional mer units such as N,N-methylenebisacrylamide or by other cross linking means, provided that the maximums set forth above as to molecular weight and/or intrinsic viscosity are not exceeded.

Mer units that may provide ionizable carboxylate groups to the polymer include without limitation acrylic acid, methacrylic acid, ethyl acrylic acid, crotonic acid, itaconic acid, maleic acid, salts of any of the foregoing, anhydrides of the diacids, and mer units with functional pendant groups that may be hydrolyzed to ionizable carboxylate groups, such as carboxylic esters of the above noted carboxylic acid containing mer units, acrylamide with a pendant amide that can be hydrolyzed to a carboxylate group, and the like.

Mer units that may provide ionizable sulfonate groups to the anionic polymer include without limitation sulfonated styrene, sulfonated N-substituted (meth-)acrylamide, including mer units such as 2-acrylamidomethylpropane sulfonic acid, which is commericially available as a monomer, or mer units that may be converted to sulfonated N-substituted (meth)acrylamide mer units by post-polymerization derivatization techniques such as described in U.S. Pat. No. 4,762,894 (Fong et al.) issued Aug. 9, 1988, U.S. Pat. No. 4,680,339 (Fong) issued July 14, 1987, U.S. Pat. No. 4,795,789 (Fong) issued Jan. 3, 1989, and U.S. Pat. No. 4,604,431 (Fong et al.) issued Aug. 5, 1986, all of which are hereby incorporated hereinto by reference.

The preparation of polymers having ionizable phosphonate groups is described in U.S. Pat. No. 4,678,840 (Fong et al.) issued July 7, 1987, incorporated hereinto by reference.

Although the benefits of the process of the present invention are not wholly lost when the cellulosic slurry is subjected to additional shear after the addition of the anionic polymer, it is believed that when at least some of the anionic polymers within the present invention are employed, the benefits of the process are diminished by such subsequent shear. Hence in preferred embodiment the process of the present invention excludes further shearing of the cellulosic slurry subsequent to the addition of the anionic polymer. In other preferred embodiment the anionic polymer is added to the cellulosic slurry after the pumping stage and prior to the application of the slurry to the papermaking screen.

In preferred embodiment, the process of the present invention is an alkaline papermaking process, such as an alkaline kraft process.

EXAMPLE 1

Preparation of Polymer A

A low molecular weight polyacrylic acid, designated herein as Polymer A, was prepared by solution polymerization at about 100° C. reflux under a nitrogen atmosphere. The initial charge to the polymerization vessel (1 liter) was 240 grams of a solution of 3.705 grams of sodium formate, 4.40 grams of 1.0 wt. percent ethylene diamine tetraacetic acid (EDTA), 1M $H_2SO_4$ to adjust the pH to 4.5, in deionized water. This initial charge was heated to reflux temperature and then an acrylic acid solution and an initiator solution were fed separately, dropwise, over a time period of about 1.75 hours. The acrylic acid solution (360 grams total) contained 195 grams of acrylic acid (2.7 moles) and sufficient 50 percent sodium hydroxide to adjust the pH to 4.48, in deionized water. The initiator solution (39.32 grams total) was 13 wt. percent sodium persulfate solution. After completion of the reaction, the reaction solution was diluted from 639.32 grams to 650.3 grams with 11 grams of deionized water.

EXAMPLE 2

Preparation of Polymer B

A low molecular weight copolymer of acrylic acid ("AA") and diallyldimethyl ammonium chloride ("DADMAC"), (Polymer B), having respective mole percentages of 85/15, was prepared in the manner described above for Example 1, with the following modifications. 400 grams of an acylic acid solution were prepared containing 216.67 grams of AA (54.1675 wt. %), 66.29 grams of 50% NaOH to adjust the pH to 4.41, and the balance was deionized water. The initial charge to the polymerization vessel was an admixture of 85.43 grams of 64.7% DADMAC solution (55.29 grams DADMAC), 3.705 grams of sodium formate, 4.40 grams of 1.0% EDTA, 30.33 grams of the acrylic acid solution noted above (16.429 grams of AA), and 100 grams of deionized water, which was then adjusted to pH of 4.50 with 50% NaOH, and diluted with further deionized water to 280 grams, and transferred to the polymerization vessel (279.7 grams total tranferred). To this initial charge was added, over a time period of about 2.25 hours, at reflux temperature, 227.6 grams of the acrylic acid solution noted above and 37.2 grams of the 13 wt. percent sodium persulfate initiator solution. Upon completion of the reaction the 544.5 grams of reaction solution was diluted to 650.0 grams with 105.5 grams of deionized water, to provide a reaction solution containing about 30.0 wt. percent polymer.

EXAMPLE 3

Preparation of Polymer C

A low molecular weight 87/13 mole percent copolymer of acrylic acid and methacrylamidopropyltrimethylammonium chloride ("MAPTAC"), designated herein Polymer C, was prepared in the manner described above for Example 1 with the following modifications. The pH of the initial charge was adjusted to 5.0 and the initial charge contained 20 less grams of deionized water (220 grams total). The AA and MAPTAC monomers were added during as a mixed monomer solution prepared by admixing 133.61 grams of acrylic acid, 50 grams of deionized water, 58.90 grams of 50% NaOH (pH to 5.0), 122.7 grams of a 50 wt. percent MAPTAC solution (61.35 grams MAPTAC), an additional 3.03 grams of 50% NaOH (pH from 4.89 to 4.96), and sufficient deionized water to provide 400 grams total, of which 393 grams were charged during reaction, as was 37.2 grams of 13 percent sodium persulfate initiator. The monomers were added in under 2 hours and the initiator was added over about 2 hours, and the reflux temperature was held for about 30 minutes beyond the additions.

EXAMPLE 4

Preparation of Polymer D

The general method described in Example 3 was used to prepare another AA/MAPTAC copolymer except that the mole percent of the monomers charged, and polymer prepared, was changed to 70/30 AA/MAPTAC, and this polymer is designated herein Polymer D.

EXAMPLE 5

Preparation of Polymer E

The general method described in Exaple 1 was used to prepare an acrylic acid polymer except that a cross linking agent, N,N-methylene bis acrylamide (MBA) was added with the acrylic acid monomer solution in the amount of 7672 ppm MBA based on acrylic acid monomer, and this polymer is designated herein as Polymer E.

In Table 1 below there is a summary of the compositions and characteristics of Polymers A to E, prepared as described above, and Polymer F, a commercial product.

TABLE 1

| Polymer Designation | Mer Units AA (mole %) | DADMAC (mole %) | MAPTAC (mole %) | MBA (ppm) | IV | Molecular Weight |
|---|---|---|---|---|---|---|
| A | 100 | — | — | — | 0.34 | 75,000 |
| B | 85 | 15 | — | — | 0.58 | — |
| C | 87 | — | 13 | — | 0.31 | — |
| D | 70 | — | 30 | — | 0.23 | — |
| E | 100 | — | — | 7700 | 0.38 | — |
| F | 100 | — | — | — | 1.00 | 300,000 |

Britt Jar Test

The Britt Jar Test employed in Examples 6 to 17 used a Britt CF Dynamic Drainage Jar developed by K. W. Britt of New York State University, which generally consists of an upper chamber of about 1 liter capacity and a bottom drainage chamber, the chambers being separated by a support screen and a drainage screen. Below the drainage chamber is a downward extending flexible tube equipped with a clamp for closure. The upper chamber is provided with a variable speed, high torque motor equipped with a 2-inch 3-bladed propeller to create controlled shear conditions in the upper chamber. The test was conducted by placing the cellulosic stock in the upper chamber and then subjecting the stock to the following sequence:

| Time | Action |
|---|---|
| 0 seconds | Commence shear stirring at 2000 rpm. |

-continued

| Time | Action |
|---|---|
| 10 seconds | Add the cationic polymer. |
| 70 seconds | Reduce shear stirring to 750 rpm. |
| 90 seconds | Add the anionic polymer (or bentonite). |
| 100 seconds | Open the tube clamp to commence drainage, and continue drainage for 12 seconds. |

The material so drained from the Britt jar (the "filtrate") is collected and diluted with water to one-third of its initial volume. The turbidity of such diluted filtrate, measured in Nephelometric Turbity Units or NTU's, is then determined. The turbidity of such a filtrate is inversely proportional to the papermaking retention performance; the lower the turbidity value, the higher is the retention of filler and/or fines. The turbidity values were determined using a Hach Turbidimeter.

The Test Stock

The cellulosic stock or slurry used in Examples 6 to 18 was comprised of 70 weight percent fiber and 30 weight percent filler, diluted to an overall consistency of 0.5 percent with formulation water. The fiber was a 50/50 blend by weight of bleached hardwood kraft and bleached softwood kraft, separately beaten to a Canadian Standard Freeness value range of from 340 to 380 C.F.S. The filler was a commercial calcium carbonate, provided in dry form. The formulation water contained 200 ppm calcium hardness (added as $CaCl_2$), 152 ppm magnesium hardness (added as $MgSO_4$) and 110 ppm bicarbonate alkalinity (added as $NaHCO_3$).

EXAMPLES 6 TO 11 AND COMPARATIVE EXAMPLE A

Using the test stock described above, the Britt Jar Test, also described above, was employed to determine retention performances of Polymers A through F in these Examples 6 to 11, in comparison to a blank and to the use of bentonite (Comparative Example a). In each test, the cationic polymer used was an acrylamide/-dimethylaminoethylacrylate methyl chloride quaternary ammonium salt copolymer having 10 mole percent of the cationic mer unit, and having a Reduced Specific Viscosity of 13.3 at 0.045 g/dl. This polymeric cationic flocculant was charged to the test stock in the amount of 0.15 parts by weight per hundred parts by weight of dry stock solids (3.0 lb/ton dry weight of slurry solids). The various anionic polymers, and the bentonite, were tested at various dosage levels, shown below in Table 2. The test results are reported in Table 2 below as diluted filtrate turbidity values (NTU's), for each of the dosages of the anionic polymer or bentonite tested; these dosages are given in lb additive per dry ton of stock solids ("lb/dry ton"). The conversion from lb/dry ton to parts by weight per hundred parts by weight of dry solids is set forth on Table 3 below.

TABLE 2

| Example No. | Anionic Polymer or Bentonite | Diluted Filtrate Turbidity (NTU) For Specified Anionic Polymer/Bentonite Dosages (lb/dry ton) 0 | 0.125 | 0.250 | 0.50 | 1.0 | 2.0 | 4.0 |
|---|---|---|---|---|---|---|---|---|
| blank | none | 525 | — | — | — | — | — | — |
| Comparative a | Bentonite | — | — | — | — | — | 260 | 200 |
| 6 | A | — | 250 | 225 | 210 | 200 | 240 | 260 |
| 7 | B | — | 350 | 250 | 250 | — | — | — |
| 8 | C | — | 350 | 300 | — | — | — | — |
| 9 | D | — | 490 | 450 | — | — | — | — |
| 10 | E | — | 260 | 215 | 190 | 210 | — | — |
| 11 | F | — | 225 | 160 | 180 | 140 | 150 | — |

TABLE 3

Additive Dosages Conversions

| lb. of additive per dry ton solids | parts by weight additive per 100 parts dry solids |
|---|---|
| 0.125 | 0.00625 |
| 0.250 | 0.0125 |
| 0.50 | 0.025 |
| 1.0 | 0.05 |
| 2.0 | 0.10 |
| 4.0 | 0.20 |
| 8.0 | 0.40 |

EXAMPLES 12 TO 17 AND COMPARATIVE EXAMPLE B

A series of Britt Jar Tests were conducted using a lesser dosage of the cationic flocculant that was used in Examples 6 to 11. In these tests, the retention performance of four acrylic acid polymers of varying molecular weights, a sodium polystryene sulfonate, and a cross-linked polyacrylic acid (Examples 12 to 17) were determined, as was that of bentonite (Comparative Example b). The polymeric cationic flocculant used was the same as described above for Examples 6 to 11, except the dosage thereof was reduced from 0.15 to 0.125 parts by weight per hundred parts by weight of dry slurry solids. The test results and the polymer identifications are set forth below in Table 4. All of the polymers tested were commercial products, and the approximate weight average molecular weights therefor are those reported in the literature for such product. The test results are given in NTU's for each of the dosages of the anionic polymer or bentonite tested. The abbreviations "poly AA" and "poly SS" are used respectively for polyacrylic acid and sodium polystyrene sulfonate.

TABLE 4

| Example No. | Anionic Polymer or Bentonite | Molecular Weight | Diluted Filtrate Turbidity (NTU) For Specified Anionic Polymer/Bentonite Dosage (lb/dry ton) 0 | 0.2 | 0.4 | 0.6 | 0.8 | 1.2 | 2.0 | 4.0 |
|---|---|---|---|---|---|---|---|---|---|---|
| blank | — | — | 510 | — | — | — | — | — | — | — |
| Comparative b | Bentonite | — | — | — | — | — | — | — | 200 | 160 |
| 12 | poly AA | 250,000 | — | 200 | 160 | 150 | — | — | — | — |
| 13 | poly AA | 300,000 | — | 200 | 140 | — | — | — | — | — |
| 14 | poly AA | 750,000 | — | 250 | 190 | 160 | — | — | — | — |
| 15 | poly AA | 1,250,000 | — | 275 | 240 | 200 | — | — | — | — |
| 16 | poly SS | 70,000 | — | — | 225 | 200 | 190 | — | — | — |
| 17 | poly AA (cross-linked) | 3,000,000 | — | — | 340 | 300 | 240 | — | — | — |

EXAMPLE 18 AND COMPARATIVE EXAMPLE C

For this Example 18 and Comparative Example c, the Britt Jar Test as described above was modified by adding to the Time/Action sequence a reshearing period after the addition of the anionic polymer or bentonite. The anionic polymer used was the polyacrylic acid having a molecular weight of about 300,000, which was used in Example 13 above. The cationic polymer flocculant was the same as used in Examples 6 to 17, and the dosage used was the 0.15 parts by weight per hundred parts by weight of dry stock solids used in Examples 6 to 11. The floc formed by the addition of the anionic polymer or bentonite was resheared for a time period of from 0 to 30 seconds, at 2000 rpm, after which the stirring was reduced to 750 rpm for 10 seconds before the tube clamp was opened to commence drainage. The results and the reshear periods used are set forth in Table 5, together with the dosages of the anionic polymer and bentonite used.

TABLE 5

| Example No. | Anionic Polymer or Bentonite | Dosage (lb/dry ton) | Diluted Filtrate Turbidity (NTU) For Specified Reshearing Times 0 sec. | 10 sec. | 20 sec. | 30 sec. |
|---|---|---|---|---|---|---|
| 18 | poly AA M. Wt. of 300,000 | 1.0 | 140 | 230 | 300 | 340 |
| Comparative Example c | Bentonite | 8.0 | 150 | 250 | 380 | 360 |

Retention

The foregoing Examples 6 to 18 and Comparative Examples a to c generally demonstrate that the soluble anionic polymers, including the ampholytic polymers, achieved turbidity reductions at about 4 to 10 times less than the dosage of bentonite required to obtain the same turbidity. Hence the retention achieved in the process using a soluble anionic polymer may be increased to high levels while using less additive, as compared to such a process in which bentonite is used.

Drainage

In conducting the testing of Examples 6 to 18 it was determined that as retention increased (turbidity decreased) the drainage efficiency, as measured in terms of the amount of filtrate obtained in the 12 second drainage period, increased, although the correlation between increased retention and increased drainage efficiency may not be a 1:1 correlation.

Formation

The effect of increased retention (decreased turbidity) on formation in Examples 6 to 18 was parallel to the effect noted for bentonite in Comparative Examples a to c. Generally in such laboratory tests there was seen some decrease in formation with increasing retention at high retention levels, and it is believed that the deleterious effect of high levels of retention on formation may be seen to be reduced at least somewhat when the process of the present invention is used on a commercial scale.

Delivery to Paper Machine

The soluble anionic polymers are easily delivered to a paper machine, while bentonite is difficult to slurry and requires expensive equipment to feed it to the machine. In preferred embodiment the water soluble anionic polymer is charged to the papermaking process as an aqueous solution of the polymer.

Unless expressly indicated otherwise, all percentages noted herein are weight percentages. The terms medium molecular weight and high molecular weight as used herein refer in many instances to a molecular weight range, and as these terms are used herein there are certain molecular weights that fall within both categories as most broadly defined. The terms anionic polymer and cationic polymer as used herein at minimum specify the predominant ionizable groups within such polymer. The term aqueous cellulosic papermaking slurry, or cellulosic slurry, as used herein is a pulp containing slurry.

INDUSTRIAL APPLICABILITY OF THE INVENTION

The present invention is applicable to the papermaking industry, including such segments of the papermaking industry that manufacture paper or paperboard or the like.

I claim:

1. A process in which paper or paperboard is made by forming an aqueous cellulosic papermaking slurry, subjectign said slurry to one or more shear stages, adding to said slurry a mineral filler prior to at least one of said shear stages, adding to said slurry after said addition of said mineral filler and prior to at least one of said shear stages at least about 0.01% by weight based on dry solids of the slurry a high molecular weight cationic polymer, draining sadi slurry to form a sheet, and drying said sheet, characterized in that said high molecular weight cationic polymer is a cationic (meth)acrylamide polymer having a molecular weight about 1,000,000 and after the addition of said high molecular weight cationic polymer and at least one shear stage subsequent therto, a medium molecular weight anionic polymer is added to said slurry in an amount of at least about 0.005% by weight based on dry solids of the slurry, and said medium molecular weight anionic polymer has a molecular weight of no more than 5,000,000, and has ionizable carboxylate groups providing an anionic charge density of at least about 4.8 equivalents per kilogram.

2. The process of claim 1 wherein said medium molecular weight anionic polyer is added to said slurry by feeding to said slurry an aqueous solution containing said medium weight anionic polymer.

3. The process of claim 1 wherein said high molecular weight cationic polymer has a cationic charge density of at least about 0.2 equivalents of cationic nitrogn per kilogram of said high molecular weight cationic polymer.

4. The process of claim 3 wherein said high molecular weight cationic polymer has a molecular weight of at least 5,000,000.

5. The process of claim 3 wherein said high molecular weight cationic polymer has a charge density of at least 0.4 equivalents of cationic nitrogen per kilogram of said high molecular weight cationic polymer.

6. The process of claim 1 wherein said high molecular weight cationic polymer contains at least 5 mole percent of cationic mer units.

7. The process of claim 1 wherein said high molecular weight cationic polymer is added to said slurry in the amount of at least 0.01weight percent based on dry weight of slurry solids.

8. The process of claim 1 wherein said slurry is drained on a papermaking screen and is pumped to the site of said papermaking screen prior to draining, and further wherein said medium molecular weight anionic polymer is added to said slurry subsequent to said pumping and prior to said draining.

9. The process of claim 1 wherein said slurry is an alkaline chemical pulp slurry.

10. The process of claim 1 wherein said mineral filler is an alkaline carbonate.

11. The process of claim 1 wherein said mineral filler is added to said slurry in the amount of from about 2 to about 50 parts by weight per hundred parts by weight of dry pulp contained in said slurry.

12. The process of claim 1 wherein said medium molecular weight anionic polymer is added to said slurry in the amount of from about 0.005 to about 0.5 parts by weight per hundred parts by weight of dry solids in said slurry.

13. The process of claim 12 wherein said medium molecular weight anionic polymer is added to said slurry in the amount of from about 0.01 to about 0.2 parts by weight per hundred parts by weight of dry solids in said slurry.

14. The process of claim 1 wherein said medium molecular weight anionic polymer is added to said slurry in the amount of from about 0.01 to about 5.0 parts by weight per hundred parts by weight of dry mineral filler, as $CaCO_3$.

15. The process of claim 1 wherein said medium molecular weight anionic polymer is added to said slurry in the amount of from about 0.05 to about 0.5 parts by weight per hundred parts by weight of dry mineral filler, as $CaCO_3$.

16. The process of claim 1 wherein said medium molecular weight anionic polymer has a weight average molecular weight of from about 30,000 to about 3,500,000.

17. The process of claim 16 wherein said medium molecular weight anionic polymer has a weight average molecular weight of from about 75,000 to about 1,250,000.

18. The process of claim 1 wherein said medium molecular weight anionic polymer has an anionic charge density of at least about 6.7 equivalents of anionic oxygen per kilogram of anionic polymer.

19. The process of claim 1 wherein said medium molecular weight anionic polymer has at least 65 mole percent of mer units having said carboxylate groups.

* * * * *

UNITED STATES PATENT AND TRADEMARK OFFICE

CERTIFICATE OF CORRECTION

PATENT NO. : 5,098,520

DATED : March 24, 1992

INVENTOR(S) : Arthur J. Begala

It is certified that error appears in the above-identified patent and that said Letters Patent is hereby corrected as shown below:

In Claim 1, lines 2-3 thereof, at Column 13, lines 62 to 63, delete "subjectign" and substitute therefor -- subjecting --.

In Claim 1, line 9 thereof, at Column 14, line 1, delete "sadi" and substitute therefor --said--.

In Claim 1, line 18 thereof, at Column 14, line 5, delete "about" and substitute therefor --above--.

In Claim 2, line 3 thereof, at Column 14, line 23, delete "nitrogn" and substitute therefor --nitrogen--.

Signed and Sealed this

Twenty-eighth Day of September, 1993

Bruce Lehman

*Attest:*

BRUCE LEHMAN

*Attesting Officer*

*Commissioner of Patents and Trademarks*